US011240594B1

(12) United States Patent
Krueger

(10) Patent No.: US 11,240,594 B1
(45) Date of Patent: Feb. 1, 2022

(54) TECHNIQUES FOR LOUDSPEAKER

(71) Applicant: Paul M. Krueger, St. Petersburg, FL (US)

(72) Inventor: Paul M. Krueger, St. Petersburg, FL (US)

( * ) Notice: Subject to any disclaimer, the term of this patent is extended or adjusted under 35 U.S.C. 154(b) by 0 days.

(21) Appl. No.: 17/094,775

(22) Filed: Nov. 10, 2020

Related U.S. Application Data

(63) Continuation of application No. 16/579,048, filed on Sep. 23, 2019, now Pat. No. 10,834,496, which is a continuation of application No. 16/049,805, filed on Jul. 30, 2018, now Pat. No. 10,425,721.

(60) Provisional application No. 62/538,608, filed on Jul. 28, 2017.

(51) Int. Cl.
*H04R 1/28* (2006.01)
*H04R 1/02* (2006.01)

(52) U.S. Cl.
CPC ..... *H04R 1/2857* (2013.01); *H04R 1/025* (2013.01); *H04R 1/2811* (2013.01)

(58) Field of Classification Search
None
See application file for complete search history.

(56) References Cited

U.S. PATENT DOCUMENTS 5,313,525 A * 5/1994 Klasco ..... H04R 1/2819 181/156
5,920,633 A * 7/1999 Yang ..... H04R 3/04 381/93
6,411,721 B1 * 6/2002 Spindler ..... H04R 1/26 181/153
8,275,164 B1 * 9/2012 Nguyen ..... H04R 1/2857 381/338

* cited by examiner

*Primary Examiner* — Kenny H Truong
(74) *Attorney, Agent, or Firm* — Jefferson IP Law, LLP; Raymond B. Persino

(57) ABSTRACT

A loudspeaker is provided that includes an outer tubular section, an inner tubular section at least partially disposed within the outer tubular section, a driver disposed in the inner tubular section, a sound deflector disposed at a first end of the outer tubular section, and a void defined collectively by a space between a first end of the inner tubular section within the outer tubular section and the sound deflector, and a space between an outer portion of the inner tubular section and an inner portion of the outer tubular section. The sound produced by the driver passes through the void via the space between the first end of the inner tubular section within the outer tubular section and the sound deflector, and then via the space between the outer portion of the inner tubular section and the inner portion of the outer tubular section.

19 Claims, 10 Drawing Sheets

TECHNIQUES FOR LOUDSPEAKER

CROSS-REFERENCE TO RELATED APPLICATION

This application is a continuation application of prior application Ser. No. 16/579,048, filed on Sep. 23, 2019, which issued as U.S. Pat. No. 10,834,496 on Nov. 10, 2020; which is a continuation application of prior application Ser. No. 16/049,805, filed on Jul. 30, 2018, which issued as U.S. Pat. No. 10,425,721 on Sep. 24, 2019; and which is based on and claims priority under 35 U.S.C. § 119(e) of U.S. Provisional Application Ser. No. 62/538,608, filed on Jul. 28, 2017, in the U.S. Patent and Trademark Office, the entire disclosure of each which is incorporated by reference herein in its entirety.

BACKGROUND

1. Field

The present invention relates to a loudspeaker.

2. Description of Related Art

A loudspeaker is an electromechanical device that converts an electrical signal into sound. There are numerous types of loudspeakers in the related art. Among the more common type of loudspeakers, is a loudspeaker comprising a driver that is coupled to an enclosure and/or baffle. The driver vibrates in response to an electrical signal, thereby producing front and rear sound waves. Some drivers are specifically designed to reproduce the sound for a particular range of frequencies. For example, some drivers are designed to produce mid or low frequencies while others are designed to reproduce the upper frequency range. Often these various drivers are used together in a single loudspeaker. When used together, these various drivers may be augmented through the use of crossover electronic elements, serving to divide the frequencies sent to each driver from an input source. The purpose of the enclosure or baffle is to provide a mounting area as well as separate the front and rear sound waves to provide a usable and wide frequency response. Without an enclosure or large baffle, the front and rear sound waves will combine destructively, making the output sound, particularly in the low frequencies, virtually inaudible. It is therefore then the goal of the loudspeaker enclosure to control the front and rear waves such that they combine in a constructive fashion, reinforcing frequencies and output sounds that are not reproduced by one wave or the other exclusively, or not combine at all.

One type of loudspeaker implements a "finite baffle" design. In a "finite baffle" design, direct radiating loudspeakers are mounted to a surface facing the listening position. The finite baffle is a board or similar structure, typically of several meters in width and height, to which the loudspeaker is affixed. The finite baffle is used to separate the front and rear waves of the loudspeaker. A loudspeaker based on a finite baffle design is a non-resonant design, whereby the air propagation of the cone is not harnessed in an enclosure, and the air volume of the enclosure is not utilized to damp the cone of the loudspeaker. Nevertheless, this design is noted for producing an open sound, but is limited in power handling, sound pressure (e.g., decibel) output, and excessive size. In addition, this design can only be fully realized indoors, and is strongly reliant on the effect of room placement and coupling.

Another type of loudspeaker separates the front and rear sound waves by virtue of a sealed enclosure, wherein the rear wave is confined within the enclosure, serving to reinforce the cone of the driver acting as an air spring. This is often referred to as acoustic suspension or the "infinite baffle". This compact design, while easy to build and tune, is notoriously inefficient, and limits low bass frequencies. This design can produce unwanted panel resonances or reflections within the enclosure that can be reflected back through the driver as well as non-linearities in the driver itself caused by the high air pressure changes in the enclosure. Other designs include the features of the acoustic suspension, but use an enclosure opening (e.g., port) sometimes including a tube or slot (e.g., a Helmholtz resonator) or a passive radiator driver to reinforce the front wave, allowing low frequencies to emanate from the port or radiator and dampen the driver at its resonance frequency. The tuning of these enclosures is known and can be reproduced through a defined formula. These designs are limited in producing a free and natural bass response, especially in the upper and mid bass regions, and produce unwanted panel resonances and standing waves. Still another design is set forth in U.S. Pat. No. 4,628,528 to Bose et al. suggests a waveguide enclosure (transmission line) whose length is determined by a formula of ¼ the wavelength of the chosen driver's resonance frequency, is designed as a labyrinth, and is typically constructed with an average cross-sectional area 1.5-3.0 times the size of the driver. Extensive acoustical stuffing material is utilized for tuning purposes. The purpose of "stuffing" is to destroy unwanted high and middle frequencies from emanating from the rear wave and out an enclosure opening (e.g., port), where only low frequencies will exit, and recombine constructively with the front wave. "Stuffing", however; creates manufacturing problems related to repeatability, loss of efficiency, and tuning reliability issues if the stuffing moves inside the enclosure. U.S. Pat. No. 6,700,984 to Holberg et al. suggests that the use of a transmission line enclosure with non-linearly tapering walls, with largest diameter near the driver and smallest diameter near the enclosure opening. It also recommends tuning based on U.S. Pat. No. 4,628,528 to Bose et al., discussed above, wherein the length of the enclosure is determined initially by a ¼ wavelength of the desired tuning frequency, with final tuning done by adding acoustical fibers (stuffing) packed into the enclosure. This design has numerous acoustical advantages over the aforementioned designs, one being the elimination of panel resonances reflecting from the enclosure and back through the driver itself, which can produce unwanted distortion and phasing issues.

All of these designs call for a front baffle with diameter or area greater than the area of the driver itself. Inherent with a baffle is baffle losses, produced when the front sound wave bounces off the enclosure and/or the enclosure sides and is projected towards the listener, out of phase with the desired sound wave. Baffles can also limit, filter, and/or destruct the output of certain frequencies measured "off axis," most commonly 30 degrees to either side of the reference loudspeaker. The published work of engineer H. F. Olson from around 1969 is often referenced for baffle diffraction effects. The results of the research suggest the use of baffles shaped as spheres or enclosure sides progressively angled away from the driver and avoiding any 90-degree angles. All of his examples assume the baffle is substantially greater in area than the actual width of the drivers themselves, however.

Loudspeakers by their very nature are compromises; with no one design embodying all of the desired characteristics of the listener.

The above information is presented as background information only to assist with an understanding of the disclosure. No determination has been made, and no assertion is made, as to whether any of the above might be applicable as prior art with regard to the disclosure.

SUMMARY OF THE DISCLOSURE

Aspects of the disclosure are to address at least the above-mentioned problems and/or disadvantages and to provide at least the advantages described below. Accordingly, an aspect of the disclosure is to provide techniques for a loudspeaker.

In accordance with an aspect of the disclosure, a loudspeaker is provided. The loudspeaker includes an outer tubular section, an inner tubular section at least partially disposed within the outer tubular section, a driver disposed in the inner tubular section, a sound deflector disposed at a first end of the outer tubular section, and a void defined collectively by a space between a first end of the inner tubular section within the outer tubular section and the sound deflector, and a space between an outer portion of the inner tubular section and an inner portion of the outer tubular section. The sound produced by the driver passes through the void via the space between the first end of the inner tubular section within the outer tubular section and the sound deflector, and then via the space between the outer portion of the inner tubular section and the inner portion of the outer tubular section.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

Figure 1A:
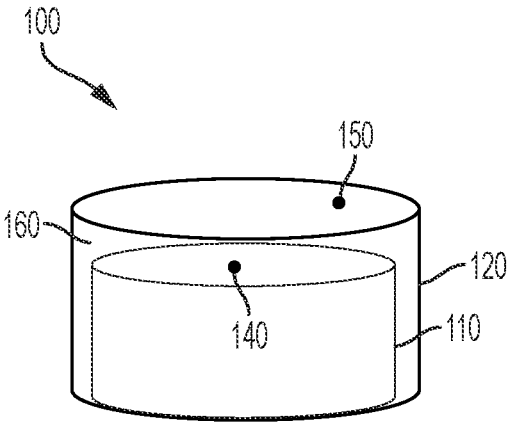
FIGS. 1A, 1B, 2A, 2B, 3A, 3B, 4A, 4B, 5A, and 5B illustrate various combinations of shapes and positions of tubular sections of various concentric loaded loudspeakers according to exemplary embodiments.
Figure 1B:
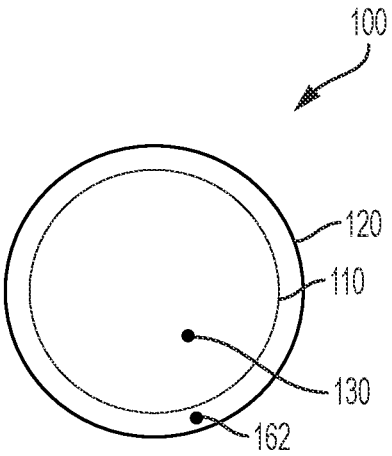
Figure 2A:
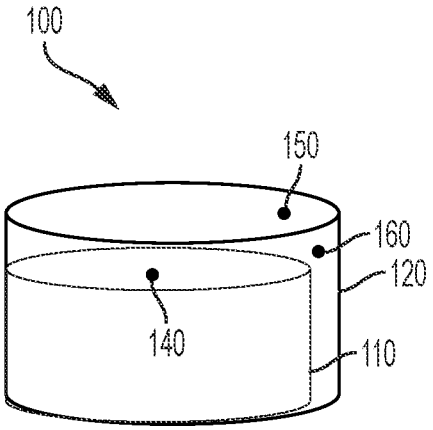
Figure 2B:
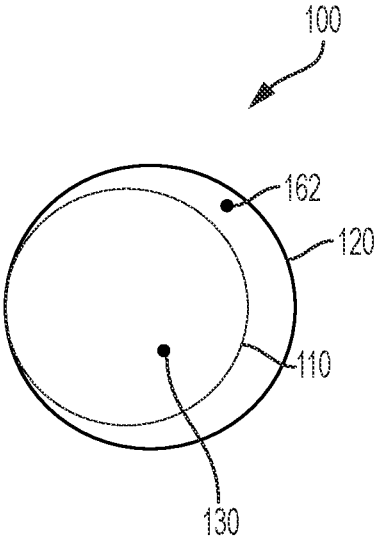
Figure 3A:
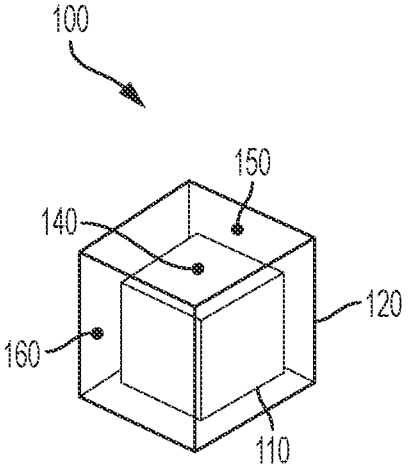
Figure 3B:
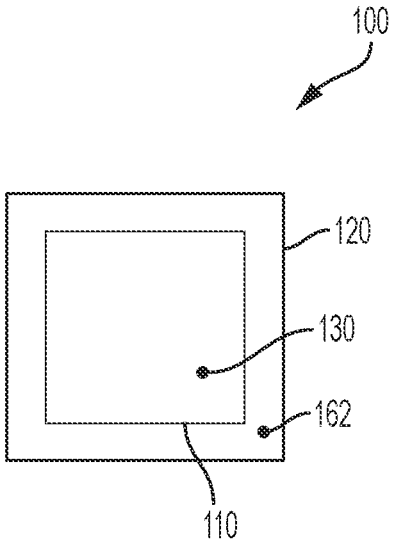
Figure 4A:
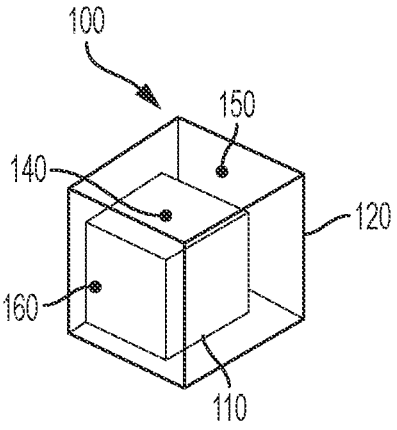
Figure 4B:
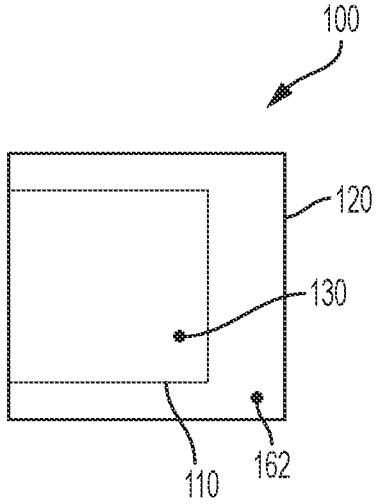

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

By the term "cross-section" it is meant a plane that is perpendicular to a length of one of at least one of an inner tubular section, an outer tubular section 120, a port, or other structure.

FIGS. 1A, 1B, 2A, 2B, 3A, 3B, 4A, 4B, 5A, 5B, 6A, 6B, 7A, 7B, 8A, 8B, 9A, 9B, 10A, 10B, 11A, 11B, 11C, 12A, 12B, 13A, 13B, 14A, 14B, 15A, 15B, 15C and 15D, discussed below, and the various embodiments used to describe the principles of the disclosure in this patent document are by way of illustration only and should not be construed in any way that would limit the scope of the disclosure. Those skilled in the art will understand that the principles of the disclosure may be implemented in any suitably arranged communications system. The terms used to describe various embodiments are exemplary. It should be understood that these are provided to merely aid the understanding of the description, and that their use and definitions in no way limit the scope of the disclosure. Terms first, second, and the like are used to differentiate between objects having the same terminology and are in no way intended to represent a chronological order, unless where explicitly stated otherwise. A set is defined as a non-empty set including at least one element.

The disclosure is directed to techniques for a concentric loaded loudspeaker. The concentric loaded loudspeaker may have advantages in reproducing mid to low frequencies. A concentric loaded loudspeaker according to an exemplary embodiment may be a stand-alone speaker. When implemented as a stand-alone speaker, the concentric loaded loudspeaker may employ a full range driver, or a driver suited to reproduction of mid to low frequencies (e.g., a subwoofer). In addition, the concentric loaded loudspeaker according to an exemplary embodiment may be a mid or low frequency section of a full range loudspeaker system in either separate enclosures or a common enclosure. Further, the concentric loaded loudspeaker of the disclosure may be implemented in a wide range of sizes. For example, the concentric loaded loudspeaker of the disclosure may be utilized in any type of device that reproduces audio, such as in headphones, portable Bluetooth speakers, devices such as the Amazon Alexa, Google Play or Apple Homepod, handheld electronic devices such as mobile phones and portable gaming devices, laptop or desktop computers, televisions, automobiles, planes, trains, and boats. Also, the concentric loaded loudspeaker of the disclosure may be utilized in full size speakers for home audio, home theater, commercial theaters, concert venues, and the like.

FIGS. 1A, 1B, 2A, 2B, 3A, 3B, 4A, 4B, 5A, and 5B illustrate various combinations of shapes and positions of tubular sections of various concentric loaded loudspeakers according to exemplary embodiments. In particular, FIGS. 1A, 2A, 3A, 4A, and 5A each illustrate three dimensional views of various combinations of shapes and positions of tubular sections of respective concentric loaded loudspeakers according to exemplary embodiments. Also, FIGS. 1B, 2B, 3B, 4B, and 5B illustrate views of an end including an exit vent of the concentric loaded loudspeakers respectively shown in FIGS. 1A, 2A, 3A, 4A, and 5A according to exemplary embodiments.

Figure 6A:
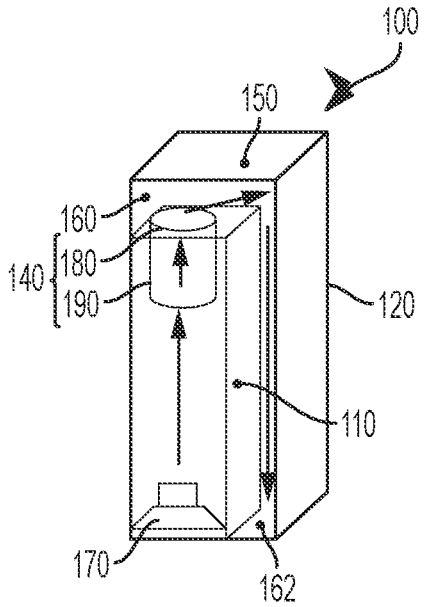
FIGS. 6A and 6B illustrate a concentric loaded loudspeaker according to an exemplary embodiment.
Figure 6B:
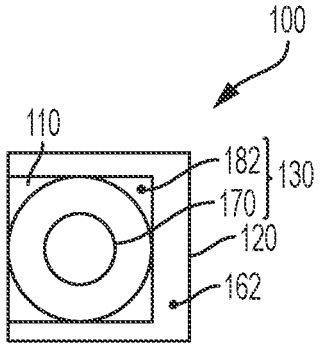
Figure 7A:
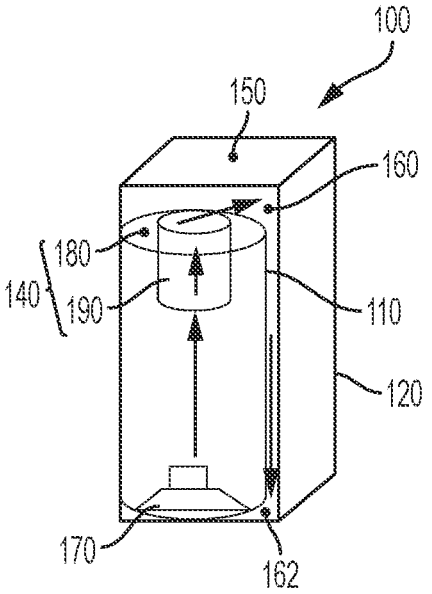
FIGS. 7A and 7B illustrate a concentric loaded loudspeaker according to an exemplary embodiment.
Figure 7B:
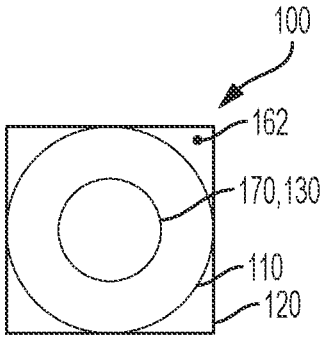
Figure 8A:
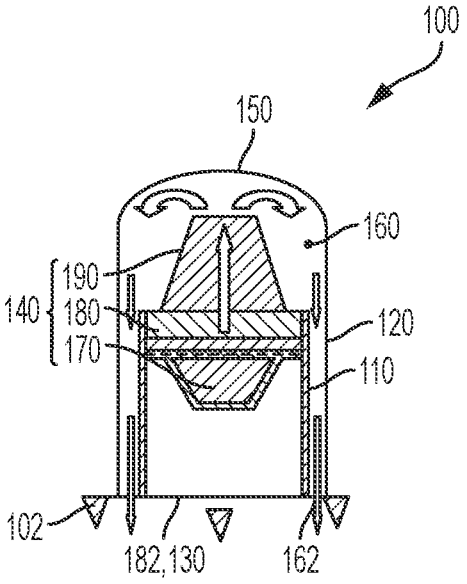
FIGS. 8A and 8B illustrate a concentric loaded loudspeaker according to an exemplary embodiment.
Figure 8B:
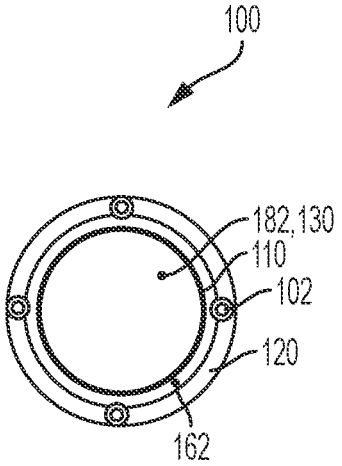
Figure 9A:
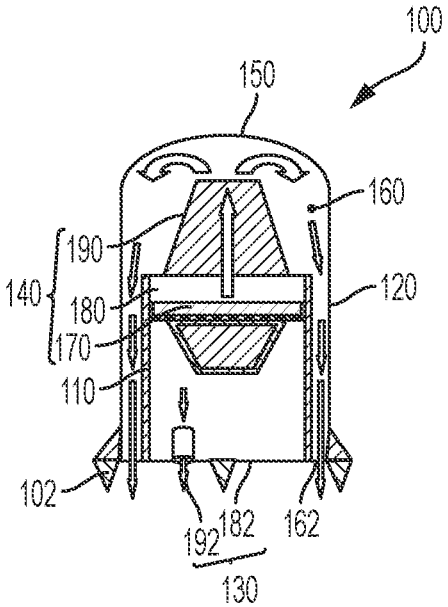
FIGS. 9A and 9B illustrate a concentric loaded loudspeaker according to an exemplary embodiment.
Figure 9B:
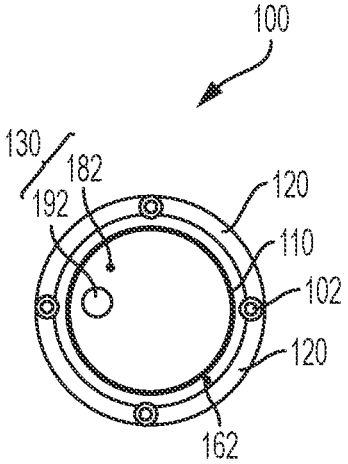
Figure 10A:
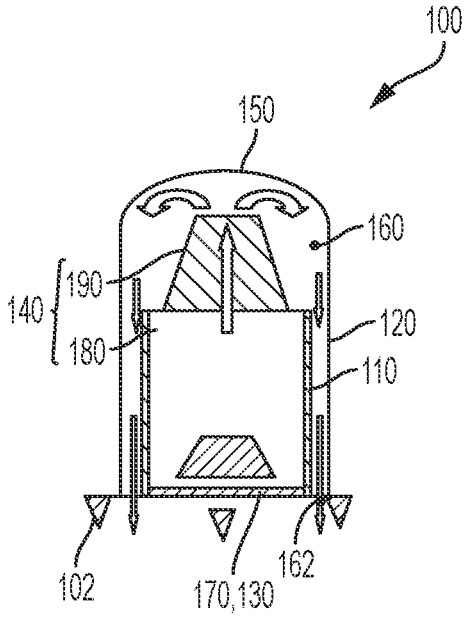
FIGS. 10A and 10B illustrate a concentric loaded loudspeaker according to an exemplary embodiment.
Figure 10B:
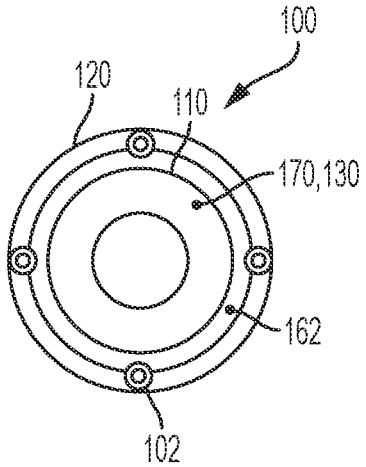
Figure 11A:
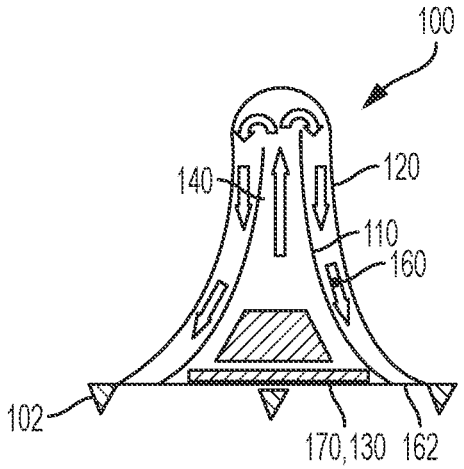
FIGS. 11A, 11B, and 11C illustrate concentric loaded loudspeakers according to exemplary embodiments.
Figure 11B:
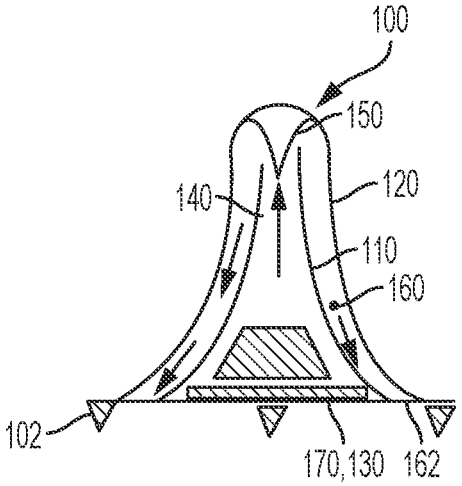
Figure 11C:
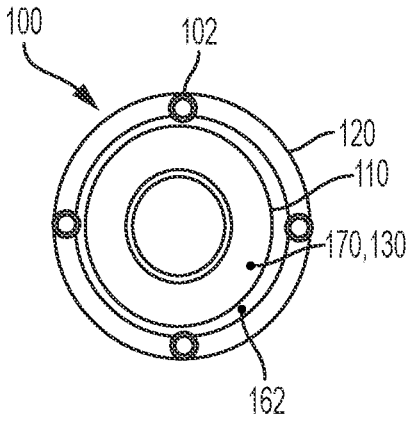
Figure 12A:
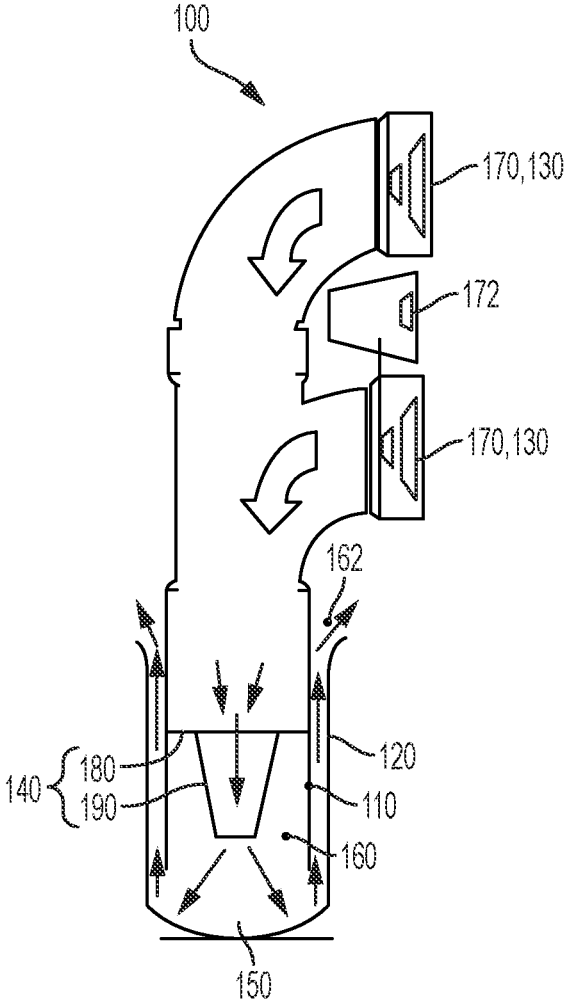
FIGS. 12A and 12B illustrate concentric loaded loudspeakers according to exemplary embodiments.
Figure 12B:
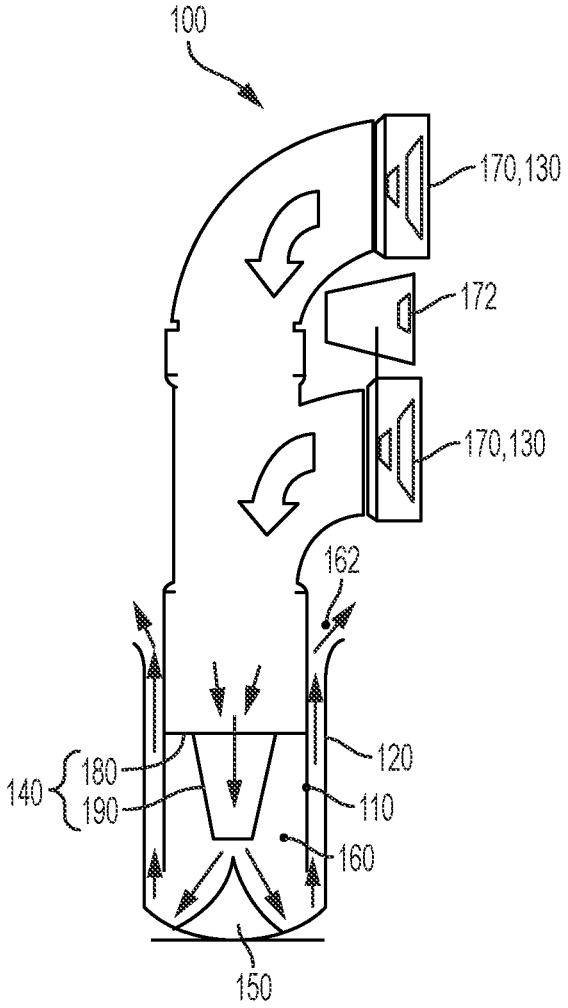
Figure 13B:
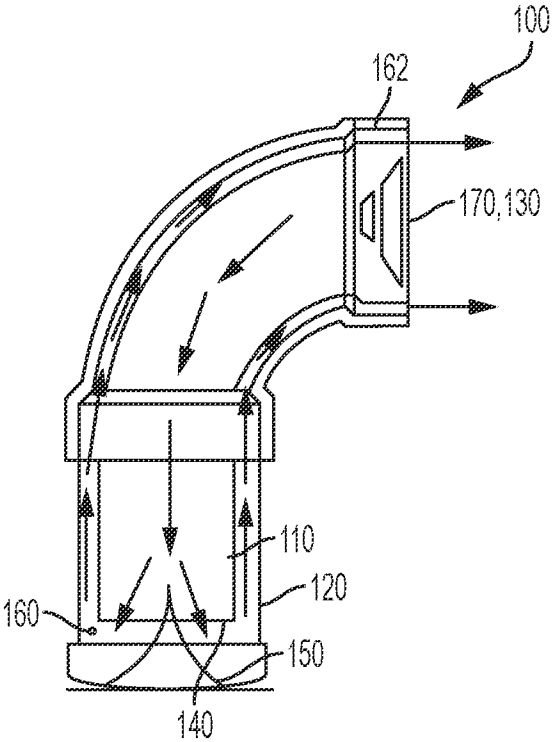
FIGS. 13A and 13B illustrate concentric loaded loudspeakers according to exemplary embodiments.
Figure 13A:
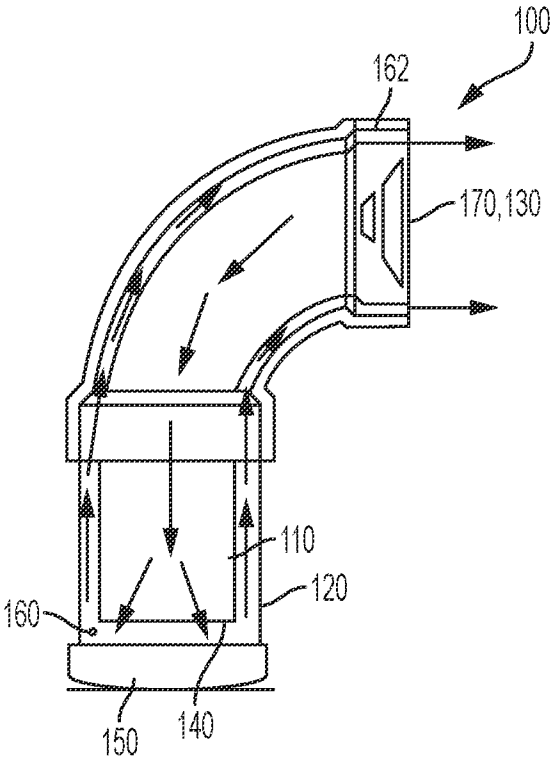
Figure 14A:
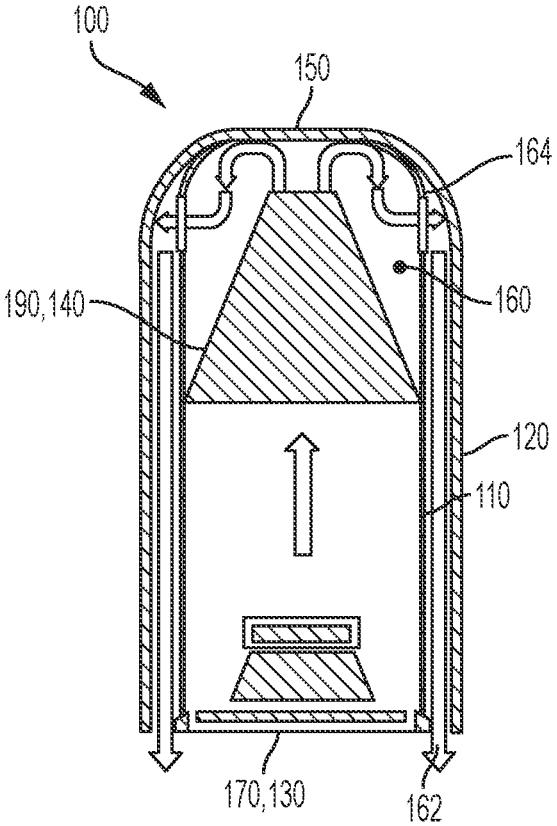
FIGS. 14A and 14B illustrate a concentric loaded loudspeaker according to an exemplary embodiment.
Figure 14B:
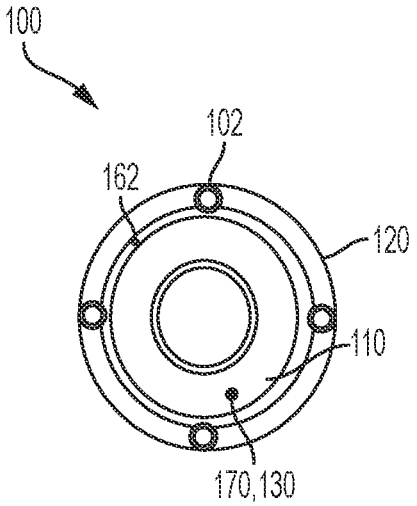

FIGS. 6A, 6B, 7A, 7B, 8A, 8B, 9A, 9B, 10A, 10B, 11A, 11B, 11C, 12A, 12B, 13A, 13B, 14A, 14B, 15A, 15B, 15C and 15D illustrate concentric loaded loudspeakers according to exemplary embodiments. In particular, FIGS. 6A and 6B illustrate a concentric loaded loudspeaker according to an exemplary embodiment. FIGS. 7A and 7B illustrate a concentric loaded loudspeaker according to an exemplary embodiment. FIGS. 8A and 8B illustrate a concentric loaded loudspeaker according to an exemplary embodiment. FIGS. 9A and 9B illustrate a concentric loaded loudspeaker according to an exemplary embodiment. FIGS. 10A and 10B illustrate a concentric loaded loudspeaker according to an exemplary embodiment. FIGS. 11A, 11B, and 11C illustrate concentric loaded loudspeakers according to exemplary embodiments. FIGS. 12A and 12B illustrate concentric loaded loudspeakers according to exemplary embodiments. FIGS. 13A and 13B illustrate concentric loaded loudspeakers according to exemplary embodiments. FIGS. 14A and 14B illustrate a concentric loaded loudspeaker according to an exemplary embodiment. FIGS. 15A, 15B, 15C, and 15D illustrate a concentric loaded loudspeaker according to an exemplary embodiment.

Figure 15A:
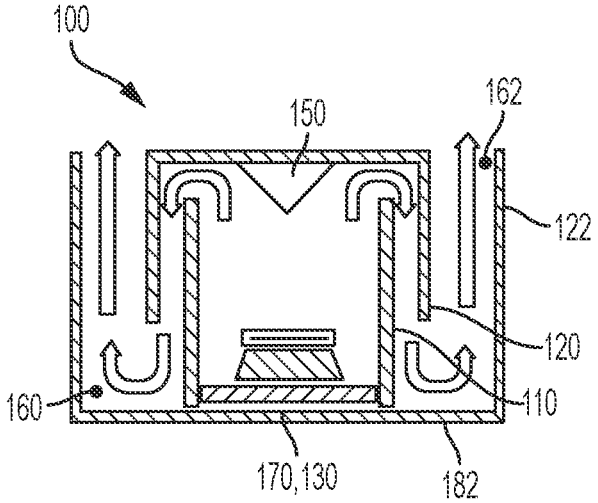
FIGS. 15A, 15B, 15C, and 15D illustrate a concentric loaded loudspeaker according to an exemplary embodiment.
Figure 15B:
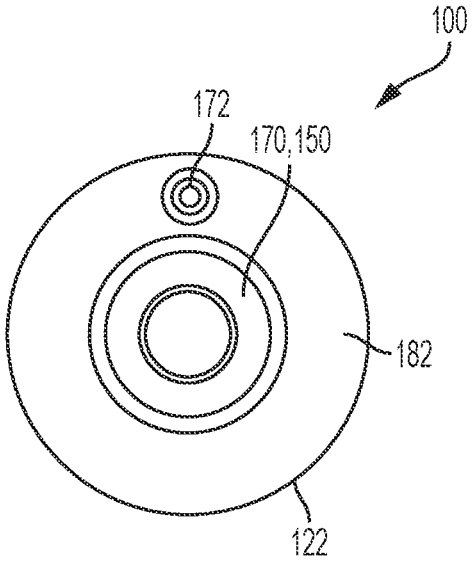
Figure 15C:
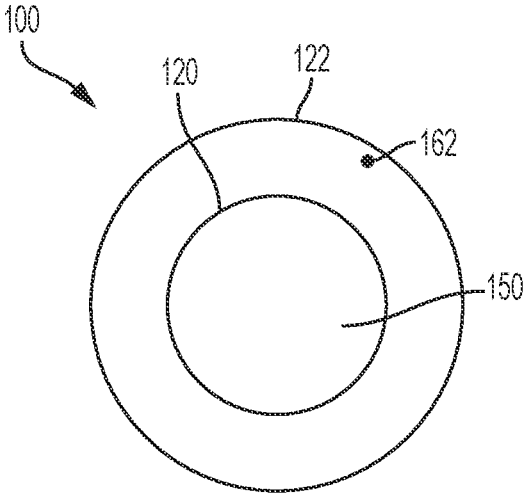
Figure 15D:
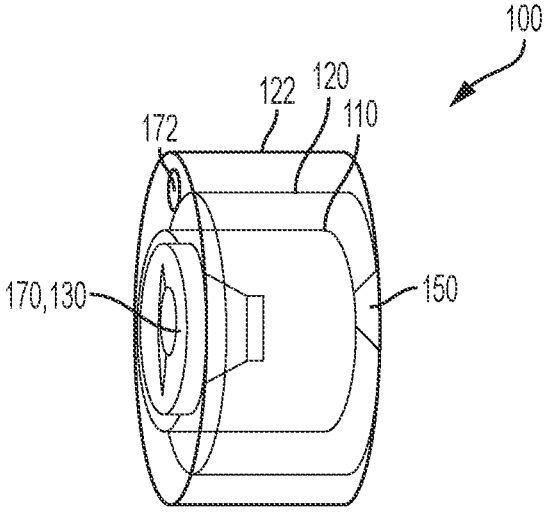

More specifically, FIGS. 6A, 7A, 8A, 9A, 10A, 11A, 11B, 12A, 12B, 13A, 13B, 14A, 15A, and 15D illustrate, at least one of three-dimensional views or views along a section running parallel to the inner and outer tubular sections, showing an internal and external structure of concentric loaded loudspeakers according to exemplary embodiments. FIGS. 6B, 7B, 8B, 9B, 10B, 11C, 14B, and 15C illustrate views of an end including an exit vent of the concentric loaded loudspeakers shown in FIGS. 6A, 7A, 8A, 9A, 10A, 11A, 11B, 14A, 15A, and 15D according to exemplary embodiments. FIG. 15B illustrate a view of an end including a driver of the concentric loaded loudspeakers shown in FIGS. 15A and 15D.

Referring to FIGS. 1A, 1B, 2A, 2B, 3A, 3B, 4A, 4B, 5A, 5B, 6A, 6B, 7A, 7B, 8A, 8B, 9A, 9B, 10A, 10B, 11A, 11B, 11C, 12A, 12B, 13A, 13B, 14A, 14B, 15A, 15B, 15C and 15D, the concentric loaded loudspeaker 100 includes an inner tubular section 110 and an outer tubular section 120. Also, the concentric loaded loudspeaker 100 includes a driver 170 configured to generate sound waves inside the inner tubular section 110. Further, the concentric loaded loudspeaker 100 includes an inner tubular section end 130. In addition, the concentric loaded loudspeaker 100 includes an inner tubular to void transition section 140. The inner tubular to void transition section 140 may be disposed at an end of the inner tubular section 110 inside the outer tubular section 120 that is opposite the inner tubular section end 130. Further, the concentric loaded loudspeaker 100 includes an optional sound deflector 150 configured to deflect sound waves generated inside the inner tubular section 110, which pass through the inner tubular to void transition section 140. The sound deflector 150 may be disposed at one end of the outer tubular section 120 near the inner tubular to void transition section 140. The inner tubular section 110 is disposed within the outer tubular section 120 such that a void 160 is collectively formed between an outer surface of the inner tubular section 110 and the inner surface of the outer tubular section 120, and between the inner tubular to void transition section 140 and the sound deflector 150. Furthermore, the concentric loaded loudspeaker 100 includes an exit vent 162 through which sounds waves pass from the void 160 to outside the concentric loaded loudspeaker 100. The use of a tubular shape for the inner tubular section 110 and the outer tubular section 120 may serve to minimize unwanted panel related resonances within the enclosure.

The total length of a sound channel of concentric loaded loudspeaker 100 is defined as the length of a line running through the center of a sound channel from one of the driver 170 or the inner tubular to void transition section 140 to the exit vent 162. The length of the sound channel of concentric loaded loudspeaker 100 may be about 8-12 times the inside cross-sectional dimension of inner tubular section 110. Further, the concentric loaded loudspeaker 100 may be configured such that any curvilinear sound channels within concentric loaded loudspeaker 100 are formed with a smooth radius.

Figure 5B:
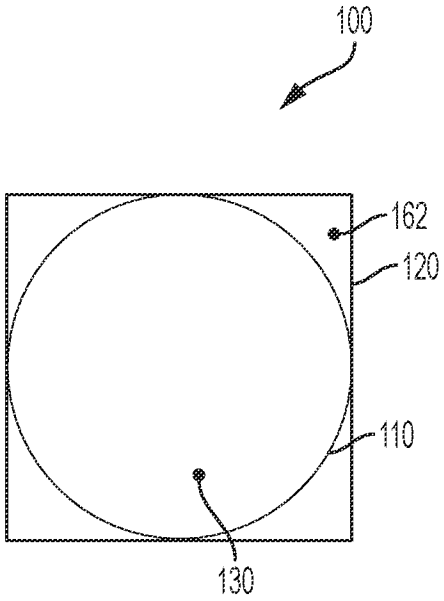
Figure 5A:
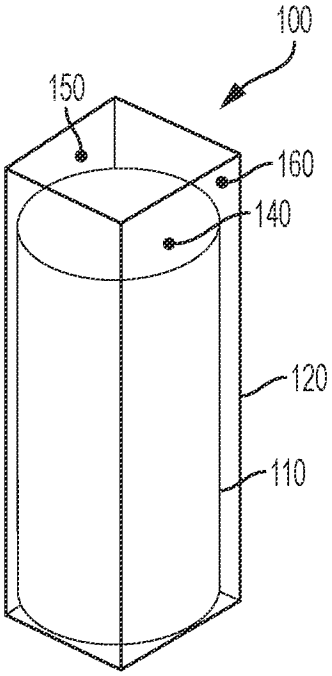

The inner tubular section 110 and the outer tubular section 120 may have substantially the same cross-sectional shape of a different size. For example, as seen in FIGS. 1A, 1B, 2A, and 2B, the inner tubular section 110 and the outer tubular section 120 may both have a cross-sectional shape that is substantially circular. In another example, as seen in FIGS. 3A, 3B, 4A, and 4B, the inner tubular section 110 and the outer tubular section 120 may both have a cross-sectional shape that is substantially square or rectangular. However, when the inner tubular section 110 and the outer tubular section 120 have substantially the same cross-sectional shape, the inner tubular section 110 and the outer tubular section 120 may also have any other closed shapes, such as a triangle or square. In addition, the inner tubular section 110 and the outer tubular section 120 may have different cross-sectional closed shapes. For example, as seen in FIGS. 5A and 5B, the inner tubular section 110 may have a cross-sectional shape that is substantially circular, and the outer tubular section 120 may have a cross-sectional shape that is substantially square or rectangular. However, when the inner tubular section 110 and the outer tubular section 120 have different cross-sectional shapes, the inner tubular section 110 and the outer tubular section 120 may each have any closed shaped. The cross-sectional shape of the inner tubular section 110 and the outer tubular section 120 may be substantially the same or may vary over the length of at least a portion of at least one of the inner tubular section 110 or the outer tubular section 120. The inner tubular section 110 and the outer tubular section 120 may be straight or curve over their length.

The inner tubular section 110 may be disposed in the outer tubular section 120 such that the void 160 is formed substantially there between and substantially around the entire exterior of the inner tubular section 110. Here, at least one of standoffs and braces may be used between the inner tubular section 110 and the outer tubular section 120 to retain the inner tubular section 110 in place relative to the outer tubular section 120. When the inner tubular section 110 is disposed in the outer tubular section 120 such that the void 160 is formed substantially around the entire exterior of the inner tubular section 110, the distance between the exterior of the inner tubular section 110 and the interior of the outer tubular section 120 may be substantially constant around the inner tubular section 110. Also, when the inner tubular section 110 is disposed in the outer tubular section 120 such that the void 160 is formed substantially around the entire exterior of the inner tubular section 110, the distance between the exterior of the inner tubular section 110 and the interior of the outer tubular section 120 may vary around the inner tubular section 110. Here, the variance in the distance between the exterior of the inner tubular section 110 and the interior of the outer tubular section 120 may be a result of at least one of the placement of the inner tubular section 110 inside the outer tubular section 120, variances in the thickness of a wall of at least one of the inner tubular section 110 or the outer tubular section 120, differences in cross sectional shape of the at least one of the inner tubular section 110 or the outer tubular section 120, or the addition of other structures within the outer tubular section 120.

The inner tubular section 110 may be disposed in the outer tubular section 120 such that a portion of the outer surface of the inner tubular section 110 contacts a portion of the inner surface of the outer tubular section 120. Here, the void 160 is formed around part of the inner tubular section 110. Also, the distance of the void 160 between the outer surface of the inner tubular section 110 and the inner surface of the outer tubular section 120 may vary. Regardless of how the inner tubular section 110 may be disposed in relation to the outer tubular section 120, given the same design or embodiment, the void 160 will have a substantially similar effective cross-sectional area.

The inner tubular section 110 may have a wall of at least one of a substantially constant thickness, or a thickness that varies over at least one of its cross-sectional shape or length. The outer tubular section 120 may have a wall of at least one of a substantially constant thickness, or a thickness that varies over at least one of its cross-sectional shape or length.

The inner tubular section 110 may be at least one of approximately the same diameter as the driver 170 as exemplified in FIGS. 7A, 7B, 8A, 8B, 9A, 9B, 10A, 10B, 11A, 11B, 11C, 13A, 13B, 14A, and 14B or larger than the diameter of the driver 170 as exemplified in FIGS. 6A and 6B. Given a cross-sectional area inside the inner tubular section 110, the length of the inner tubular section 110 is determined by a target low frequency. The length of the inner tubular section 110 may be approximately 70-90% the length of the outer tubular section 120.

The outer tubular section 120 may be sized such that the resulting cross-sectional area inside the outer tubular section 120, after subtracting the cross-sectional area of the entire inner tubular section 110, is at least one of larger than the cross-sectional area inside the inner tubular section 110, substantially the same as the cross-sectional area inside the inner tubular section 110, or smaller than the cross-sectional area inside the inner tubular section 110. When the outer tubular section 120 is sized such that the resulting cross-sectional area inside the outer tubular section 120, after subtracting the cross-sectional area of the entire inner tubular section 110, is smaller than the cross-sectional area inside the inner tubular section 110, the resulting cross-sectional area inside the outer tubular section 120, after subtracting the cross-sectional area of the entire inner tubular section 110, may be ⅔ to ¾ the cross-sectional area inside the inner tubular section 110. Given a cross-sectional area inside the outer tubular section 120, the length of the outer tubular section 120 may be determined by the target low frequency.

The inner tubular to void transition section 140 may be an opening having a diameter of the inner side of the inner tubular section 110 at one of an end of the inner tubular section 110 inside the outer tubular section 120, or another portion of the inner tubular section 110 that is inside the outer tubular section 120. For example, FIGS. 11A, 11B, 13A, 13B, and 15B show that an inner tubular to void transition section 140 may be an opening having a diameter of the inner side of the inner tubular section 110 at one of an end of the inner tubular section 110 inside the outer tubular section 120 or outside the outer tubular section 120. As exemplified in FIGS. 6A, 7A, 8A, 9A, 10A, 12A, and 12B, the inner tubular to void transition section 140 may include a baffle 180 that seals the inner tubular section 110 at an end of the inner tubular section 110 inside the outer tubular section 120, and that includes a port 190 between the inside of the inner tubular section 110 and the void 160. Here, the port 190 may have a cross-sectional area determined by the target low frequency. The port 190 may have any cross-sectional closed shape, such as an ellipse, circle, square, rectangle, square, triangle. Also, the port 190 may have a length determined by the target low frequency. The port 190 may have a wall of at least one of a substantially constant thickness over at least one of its cross-sectional shape or length, or a thickness that varies over at least one of its cross-sectional shape or length. The port 190 may serve as at least part of a constriction, which is described further below. The port 190 may extend into at least one of the inside of the inner tubular section 110 or the void 160. In addition, the inner tubular to void transition section 140 may be at least one passive radiator. Still further, the inner tubular to void transition section 140 may be the driver 170 or the combination of the driver 170 in conjunction with at least one of the baffle 180 or port 190 as exemplified in FIGS. 8A and 9A. Here the driver 170 may face towards or away from the void 160. When the inner tubular to void transition section 140 includes a passive radiator or the driver 170, a constriction may be utilized. While one port 190 has been described with respect to the inner tubular to void transition section 140, a plurality of ports 190 may be implemented. Also, while one driver 170 has been described with respect to the inner tubular to void transition section 140, a plurality of driver's may be used either in the same direction or in opposite directions. In addition, the combination of a driver and at least one passive radiator may be used.

The inner tubular section end 130, which is the end of the inner tubular section 110 opposite the end including the inner tubular to void transition section 140, may be recessed relative to an end of the outer tubular section 120, flush with an end of the outer tubular section 120, or extend away from the end of the outer tubular section 120 as exemplified in FIGS. 12A and 12B. The inner tubular section end 130 may include an opening having a diameter of the inner side of the inner tubular section 110. Also, the inner tubular section end 130 may include a baffle 182 that seals the inner tubular section 110 at that end of the inner tubular section 110 as seen in FIGS. 8A and 8B. Here, the baffle 182 may include a port 192 between the inside of the inner tubular section 110 and outside the concentric loaded loudspeaker 100 as seen in FIGS. 9A and 9B. The port 192 may have a cross-sectional area determined by the target low frequency. In addition, the port 192 may have any cross-sectional closed shape, such as an ellipse, circle, square, rectangle, square, triangle. Also, the port 192 may have a length determined by the target low frequency. The port 192 may have a wall of at least one of a substantially constant thickness over at least one of its cross-sectional shape or length, or a thickness that varies over at least one of its cross-sectional shape or length. The port 192 may extend into at least one of the inside of the inner tubular section 110 or outside the concentric loaded loudspeaker 100. In addition, the inner tubular section end 130 may include a passive radiator. Still further, the inner tubular section end 130 may include the driver 170 (or a second driver 170) as seen in FIGS. 7A, 7B, 10A, 10B, 11A, 11B, 11C, 14A, and 14B or a combination of a baffle 182 and the driver 170 (or a second driver 170) as seen in FIGS. 6A and 6B. Here the driver 170 may face towards or away from outside the concentric loaded loudspeaker 100. While one port 192 has been described with respect to the inner tubular section end 130, a plurality of ports 192 may be implemented. Also, while one driver 170 has been described with respect to the inner tubular section end 130, a plurality of driver's may be used either in the same direction or in opposite directions as exemplified in FIGS. 12 and 12B. In addition, the combination of a driver and at least one passive radiator may be used.

The driver 170 may be mounted inside the inner tubular section 110 anywhere along the length of the inner tubular section 110, including being disposed at at least one of inner tubular section end 130 or the inner tubular to void transition section 140. The driver 170 may be a circular diver, square driver, or driver of any shape. The driver 170 may be a plurality of drivers mounted in a baffle. The driver 170 may be a plurality of drivers mounted in an isobaric or push-pull configuration. The driver 170 may be mounted anywhere along the length of the inner tubular section 110. The driver 170 may be configured as a full range driver or a limited range driver (e.g., subwoofer). The inner tubular section 110 may be implemented with a plurality of drivers 170. The concentric loaded loudspeaker 100 may include at least one other driver than driver 170, such as driver 172 as exemplified in FIGS. 12A, 12B, 15B, and 15D. The driver 172 may be configured to reproduce a different frequency range than driver 170. The driver 172 may be a different size than driver 170. The driver 170 may include a sound penetrable protective cover such as a grate, a grill, cloth, a screen, or the like. When implemented with the sound penetrable protective cover, the sound penetrable protective cover is configured to operates as a protective barrier for the driver 170.

The void 160 serves as a sound channel though which sound waves, generated in the inner tubular section 110, pass on their way to the exit vent 162. Examples of the sound channels are depicted in FIGS. 6A, 7A, 8A, 9A, 10A, 11A, 11B, 12A, 12B, 13A, 13B, 14A, and 15A as arrows. The void 160 may be configured such that the path the sounds waves pass therethrough are substantially parallel but opposite to the direction the sounds waves pass upon being emitted from at least one of the driver 170 or the inner tubular to void transition section. 140. Depending on the implementation of the inner tubular section 110 and outer tubular section 120, a portion of the void 160 between the inner tubular section 110 and outer tubular section 120 may be a shape that corresponds to the cross-sectional shape of the cross-sectional area inside the outer tubular section 120, minus the cross-sectional area of the entire inner tubular section 110. For example, the cross-sectional shape of the portion of the void 160 between the inner tubular section 110 and outer tubular section 120 may correspond the circumference of a circle, perimeter of a square or rectangle, a crescent shape, or any other shape resulting from the configuration of the inner tubular section 110 and outer tubular section 120. The void 160 may serve as at least part of a constriction, which is described further below. The void 160 may include a constriction structure 164, as exemplified in FIG. 14A, in the sound channel to form at least a part of the constriction.

In an embodiment, the exit vent 162 may surround at least a portion of the driver 170 as exemplified in FIGS. 6A, 6B, 7A, 7B, 10A, 10B, 11A, 11B, 11C, 13A, 13B, 14A, and 14B. Also, the exit vent 162 may face downward as exemplified in FIGS. 6A, 6B, 7A, 7B, 8A, 8B, 9A, 9B, 10A, 10B, 11A, 11B, 11C, 14A, 14B, 15A, 15C, and 15D, or in a direction towards a listener as seen in FIGS. 13A, and 13B. Still further, the exit vent 162 may face in a plurality of directions at least one of towards and away from a listener as seen in FIGS. 12A, and 12B. Depending on the implementation of the inner tubular section 110 and outer tubular section 120, the exit vent 162 may be a shape that substantially corresponds to the cross-sectional shape of the cross-sectional area inside the outer tubular section 120, minus the cross-sectional area of the entire inner tubular section 110. For example, the cross-sectional shape of the exit vent 162 may correspond the circumference of a circle, perimeter of a square or rectangle, a crescent shape, or any other shape. The exit vent 162 may be a shape that does not corresponds to the cross-sectional shape of the cross-sectional area inside the outer tubular section 120, minus the cross-sectional area of the entire inner tubular section 110. Here, the exit vent 162 may have any cross-sectional closed shape, such as an ellipse, circle, square, rectangle, square, triangle. Also, the exit vent 162 may include a structure having a length. The length may be determined by the target low frequency. The exit vent 162 may have a wall of at least one of a substantially constant thickness over at least one of its cross-sectional shape or length, or a thickness that varies over at least one of its cross-sectional shape or length. For example, the exit vent 162 may include an annular deflecting ring that may smoothly curve away from the concentric loaded loudspeaker 100 as seen in FIGS. 12A and 12B. The cross-sectional shape of the curve may be may be linear, exponential, hyperbolic, parabolic, a "tractrix" or any combination thereof. In addition, the cross-sectional shape may be any other type of or combination of types of curves or shapes. The exit vent 162 may serve as at least part of a constriction, which is described further below. The exit vent 162 may extend into at least one of the inside the void 160 and outside the concentric loaded loudspeaker 100. The exit vent 162 may include a sound penetrable protective cover such as a grate, a grill, cloth, a screen, or the like. When implemented with the sound penetrable protective cover, the sound penetrable protective cover is adapted for preventing any extraneous materials from entering the concentric loaded loudspeaker 100 and may prevent any sound-absorbing material from leaving concentric loaded loudspeaker 100.

The sound deflector 150 may seal an end of the outer tubular section 120 so as direct the sound waves emitted from the inner tubular to void transition section 140 towards the portion of the void 160 between the outer surface of the inner tubular section 110 and the inner surface of the outer tubular section 120 as seen in FIGS. 6A, 7A, 8A, 9A, 10A, 11A, 11B, 12A, 12B, 13A, 13B, 14A, 15A, and 15D. The sound deflector 150 may be any shape, including shapes that direct the sound waves emitted from the inner tubular to void transition section 140 towards the portion of the void 160 between the outer surface of the inner tubular section 110 and the inner surface of the outer tubular section 120. For example, the sound deflector 150 may include a cone shaped structure as exemplified in FIGS. 11B, 12B, 13B, 15A, and 15D, a rounded surface, or other shape that direct the sound waves emitted from the inner tubular to void transition section 140 towards the portion of the void 160 between the outer surface of the inner tubular section 110 and the inner surface of the outer tubular section 120. The sound deflector 150 may include a curve that is linear, exponential, hyperbolic, parabolic, a "tractrix" or any combination thereof. In addition, the shape may be any other type of or combination of types of curves or shapes.

At least one of the inner tubular section 110, the outer tubular section 120, the inner tubular to void transition section 140, the sound deflector 150, the baffle 180, the baffle 182, the port 190, the port 192, or any other portion of the concentric loaded loudspeaker 100 may be constructed of one or more of plastics, polymers, polycarbonate, polyvinyl chloride (PVC), chlorinated polyvinyl chloride (PVC), pc/abs blend, nylon 66, abs, aluminum, steel, carbon fiber, resin, stainless steel, wood or any other rigid material. The inner tubular section 110, the outer tubular section 120, the inner tubular to void transition section 140, the sound deflector 150, the baffle 180, the baffle 182, the port 190, and the port 192 may be separately formed. However, any number of one or more of the inner tubular section 110, the outer tubular section 120, the inner tubular to void transition section 140, the sound deflector 150, the baffle 180, the baffle 182, the port 190, or the port 192 may be collectively formed. Further, any number of one or more of the inner tubular section 110, the outer tubular section 120, the inner tubular to void transition section 140, the sound deflector 150, the baffle 180, the baffle 182, the port 190, or the port 192 may be collectively or individually formed using a mold or via three-dimensional (3D) printing.

The concentric loaded loudspeaker 100 may be constructed in one of various ways. The concentric loaded loudspeaker 100 may be constructed of plural sections that are mated together by glue, friction fitted, clamped, screwed, or held together by any other manner of retaining two structures together. For example, the plural sections may be conventional PVC pipe sections that are frictionally and removably coupled together as seen in FIGS. 12A, 12B, 13, A and 13B. Also, the concentric loaded loudspeaker 100 may be formed as two or more clamshells that are mated together. In addition, the concentric loaded loudspeaker 100 may be formed as a single body using a mold, extrusion process, or via three 3D printing.

At least a portion of the interior walls of the enclosure may be lined with a fibrous sound-absorbing material of approximately ¼-½ inch in thickness. In some embodiments, at least a portion of the inside of the inner tubular section 110 is at least partially stuffed with fibrous sound-absorbing material at approximately ½ pound per cubic foot of volume. In still other embodiments, one or more sections of void 160 may be stuffed with fibrous sound-absorbing material while one or more other sections may be lined with the fibrous sound-absorbing material. In the embodiments where fibrous sound-absorbing material is employed, varying the amount of fibrous sound-absorbing material may vary the tuning. Accordingly, tuning is to be at least partially achieved by varying the amount of fibrous sound-absorbing material, that amount of sound-absorbing material may be determined by trial and error. The fibrous sound-absorbing material when stuffed or lined serves as a transmission medium for assisting in the projection of lower frequency audible sound through at least one of the inside of the inner tubular section 110 or the void 160. The fibrous sound-absorbing material when stuffed or lined also dampens any possible resonance generated and attenuates higher frequencies. The fibrous sound-absorbing material may be formed of polyester, nylon, fiberglass or any other sound-absorbing material.

The constriction is a reduction in the cross-section area of the void 160 relative to the sound channel for a length of the void 160 between the driver 170 and the exit vent 162. The constriction may be found at one or more of various points in the void 160 along the path from the driver 170 and to the exit vent 162. For example, the constriction may be located at the inner tubular to void transition section 140, in the portion of the void 160 between the inner tubular section 110 and outer tubular section 120, another portion of the void 160, or some combination thereof. For example, the constriction structure 164, as exemplified in FIG. 14A, may be included in the sound channel to form at least a part of the constriction. The constriction may have a length '1' with a substantially constant inside dimension 'y', wherein the inside dimension 'y' is less than inside dimension 'x' of the void 160 where the constriction is located. Also, the constriction may be tapered with one end having substantially the same dimension 'x' of the void 160 where the constriction is located and the other end having inside dimension 'y'. The tapering may be linear, exponential, hyperbolic, parabolic, a "tractrix" or any combination thereof. In addition, the tapering may be any other type or combination of types of tapering. Further, a tapered constriction may be installed in either direction. When more than one constriction is employed in the concentric loaded loudspeaker 100, any number of the more than one constriction may be different from or identical to one another. The constriction may be tubular structure. When the constriction is implemented with a tubular structure, a holding member may be used that supports the constriction. The holding member and the constriction may be constructed of separate components or formed as a single component. Further, constriction may be formed as at least part of the inner tubular section 110, the outer tubular section 120, the inner tubular to void transition section 140, the sound deflector 150, or within the concentric loaded loudspeaker 100 at one or more of any other location within the void 160. The constriction may serve to acoustically couple a part of the void 160 on one side of the constriction from another part of the void 160 on the other side of the constriction. The inside dimension 'y' of the constriction is about ½ to ⅔rd of the inside dimension 'x' of the void 160 where the constriction is located. Further, the length of constriction may be about ⅕th to ⅒th the total length of the sound channel of concentric loaded loudspeaker 100. The portion of constriction closest to driver 170 may be disposed at about the midpoint of the total length of the sound channel of concentric loaded loudspeaker 100.

By using the constriction and when the concentric loaded loudspeaker 100 is properly tuned, the concentric loaded loudspeaker 100 may exhibit lower distortion, lower frequency cutoff, increased efficiency and output, and a flatter impedance. It is difficult to form a mathematical model for tuning concentric loaded loudspeaker 100, so a trial and error methodology may be implemented for tuning concentric loaded loudspeaker 100. In embodiments where fibrous sound-absorbing material is at least partially stuff inside the concentric loaded loudspeaker 100, tuning is further carried out by adjusting the amount of fibrous sound-absorbing material that is stuffed inside the concentric loaded loudspeaker 100.

While the concentric loaded loudspeaker 100 has been described with one inner tubular section 110 and one outer tubular section 120, the concentric loaded loudspeaker 100 is not limited thereto. The concentric loaded loudspeaker 100 may include a plurality of concentric tubular sections as exemplified in FIGS. 15A and 15D. For example, when a plurality of concentric tubular sections is employed, the void 160 extends from at least one of driver 170 to exit vent 162 of a second outer tubular section 122. While not shown in FIGS. 15A, 15B, 15C, and 15D, an inner tubular to void transition section 140 as described above may be utilized. As exemplified in FIGS. 15A, 15B, 15C, and 15D, the void includes a folded concentric sound channel with a plurality of folds with each concentric sound channel passing sound waves in an opposite direction. In this configuration, the driver 170 may face in an opposite direction as the direction the exit vent 162 faces. Here, one of more of the concentric sound channels may serve as the constriction. As exemplified in FIGS. 15A, 15B, and 15D, the inner tubular section end 130 may include the driver and baffle 182, with baffle 182 extending to be included as part of the next concentric sound channel. As exemplified in FIG. 15B, driver 172 may additionally be included. Also, as exemplified in FIG. 15C, the exit vent 162 may surround the sound deflector 150. As exemplified in FIG. 15C, the sound deflector 150 may include a cone shaped structure protruding into the void 160. While not shown in FIGS. 15A, 15B, 15C, and 15D, and an additional concentric tubular section may be used so as to direct the exit vent 162 in the same direction as the driver 130.

The concentric loaded loudspeaker 100 may operate in any orientation. The concentric loaded loudspeaker 100 may include support structures (e.g., feet, mounting member, or brackets) for enable the concentric loaded loudspeaker 100 to stand on or be attached to a surface. For example, the concentric loaded loudspeaker 100 may include feet 102 as exemplified in FIGS. 8A, 8B, 9A, 9B, 10A, 10B, 11A, 11B, 11C, and 14B.

The concentric loaded loudspeaker 100 may be fitted with a crossover and/or amplifier that is electrically coupled to driver 170. In addition, wiring for energizing the driver 170 is at least partially routed through the concentric loaded loudspeaker 100.

While some features that are common to some embodiments have been discussed above, not all features that are common have been discussed above and not all features discussed above are common to all embodiments. Further, it would be apparent to one of skill in the art that variations to the location, dimensions, angles, radiuses, number of parts, and the like, may be made within the scope of the disclosure. That is, any combination of any aspect of the concentric loaded loudspeaker 100 described or illustrated herein either explicitly, inherently, or implicitly are an embodiment of the disclosure.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed:

1. A loudspeaker comprising:

an outer tubular section;

an inner tubular section at least partially disposed within the outer tubular section;

a driver disposed in the inner tubular section;

a sound deflector disposed at a first end of the outer tubular section; and a void defined collectively by a space between a first end of the inner tubular section within the outer tubular section and the sound deflector, and a plurality of spaces between an outer portion of the inner tubular section and an inner portion of the outer tubular section, wherein sound produced by the driver passes through the void via the space between the first end of the inner tubular section within the outer tubular section and the sound deflector, and then via the plurality of spaces between the outer portion of the inner tubular section and the inner portion of the outer tubular section, and wherein the plurality of spaces are each along a path the sound passes.

2. The loudspeaker of claim 1, further comprising:

at least one exit vent disposed at a second end of the outer tubular section and defined by one of the outer portion of the inner tubular section and the inner portion of the outer tubular section or the plurality of spaces between the outer portion of the inner tubular section and the inner portion of the outer tubular section, wherein the sound passing through the plurality of spaces between the outer portion of the inner tubular section and the inner portion of the outer tubular section exits the loudspeaker through the at least one exit vent.

3. The loudspeaker of claim 2, wherein the driver is disposed at a second end of the inner tubular section, and wherein the at least one exit vent at least partially surrounds the driver.

4. The loudspeaker of claim 3, wherein the driver and the at least one exit vent face a direction of a listener.

5. The loudspeaker of claim 3, wherein the driver and the at least one exit vent face downward.

6. The loudspeaker of claim 1, wherein the sound deflector comprises a structure protruding into the void configured to direct the sound from the space between the first end of the inner tubular section within the outer tubular section and the sound deflector, to the plurality of spaces between the outer portion of the inner tubular section and the inner portion of the outer tubular section.

7. The loudspeaker of claim 1, further comprising:

a constriction in the void along a path the sound passes.

8. The loudspeaker of claim 7, wherein the constriction is disposed at the first end of the inner tubular section.

9. The loudspeaker of claim 8, wherein the constriction comprises a tapered port.

10. The loudspeaker of claim 7, wherein the constriction is at least one of formed by the plurality of spaces between the outer portion of the inner tubular section and the inner portion of the outer tubular section, or disposed in the plurality of spaces between the outer portion of the inner tubular section and the inner portion of the outer tubular section.

11. The loudspeaker of claim 1, wherein the driver is disposed within the inner tubular section, wherein a baffle is disposed at a second end of the inner tubular section, and wherein at least one exit vent at least partially surrounds the baffle.

12. The loudspeaker of claim 11, wherein the baffle comprises a port.

13. The loudspeaker of claim 1, further comprising:

another outer tubular section, wherein the outer tubular section is at least partially disposed within the other outer tubular section.

14. The loudspeaker of claim 1, wherein the outer tubular section and the inner tubular section comprise a same cross-sectional shape.

15. The loudspeaker of claim 1, wherein the outer tubular section and the inner tubular section comprise a different cross-sectional shape.

16. The loudspeaker of claim 1, wherein the driver is configured to produce a full audio range.

17. The loudspeaker of claim 1, wherein the driver is configured to produce a low frequency audio range.

18. The loudspeaker of claim 1, wherein the inner tubular section is centered in the outer tubular section.

19. The loudspeaker of claim 1, wherein the inner tubular section is offset from center in the outer tubular section.

* * * * *